US005313888A

United States Patent [19]

Martin

[11] Patent Number: 5,313,888

[45] Date of Patent: May 24, 1994

[54] PULL-WIRE IGNITER FOR FLARES

[76] Inventor: Brian D. Martin, 15255 W. Maple Ave., Golden, Colo. 80401

[21] Appl. No.: 878,617

[22] Filed: May 5, 1992

[51] Int. Cl.[5] ..... F42B 4/00; F42B 4/26; C06C 9/00

[52] U.S. Cl. ..... 102/334; 102/205; 102/275.11; 102/336; 86/20.1; 86/20.11

[58] Field of Search ..... 102/205, 275.9, 275.11, 102/334, 335, 336; 86/20.1, 20.11, 20.12, 20.13

[56] References Cited

U.S. PATENT DOCUMENTS

| | | | |
|---|---|---|---|
| 66,644 | 7/1867 | Simpson et al. | 102/205 |
| 82,586 | 9/1868 | Beach . | |
| 333,655 | 1/1886 | Michaelis . | |
| 379,147 | 3/1888 | Andrews . | |
| 549,297 | 11/1895 | Sharp et al. . | |
| 2,476,125 | 7/1949 | Van Karner | 102/334 |
| 2,807,208 | 9/1957 | McKown | 102/336 |
| 3,354,829 | 11/1967 | Nichols | 102/334 |
| 3,416,450 | 12/1968 | Ballreich et al. . | |
| 3,942,445 | 3/1976 | Baker et al. . | |
| 4,493,240 | 1/1985 | Norton | 102/205 |
| 4,768,439 | 9/1988 | Singer et al. | 102/336 |
| 4,805,533 | 2/1989 | Herold et al. | 102/341 |
| 4,807,534 | 2/1989 | Vockensperger et al. | 102/489 |
| 4,846,067 | 7/1989 | Martin | 102/205 |

FOREIGN PATENT DOCUMENTS

| | | | |
|---|---|---|---|
| 463980 | 3/1950 | Canada | 102/205 |
| 479622 | 12/1951 | Canada | 102/334 |
| 1171787 | 6/1964 | Fed. Rep. of Germany | 102/336 |

*Primary Examiner*—Harold J. Tudor
*Attorney, Agent, or Firm*—James E. Pittenger

[57] ABSTRACT

The invention includes a pull-wire igniter for a pyrotechnic distress or signalling device which includes a hollow, elongated, tubular body which has a pyrotechnic composition mixture packed into one portion of the body and a small diameter, central passageway is formed through the pyrotechnic composition. A thin elongated plastic center tube is inserted through the central passageway. The outer end of the center tube is recessed at the outer end of the composition. An igniter cup is positioned firmly within the end of the center tube. A pull-wire device extends through the center tube and is exposed at the opposite end of the body so that the user can grasp the pull-wire. The igniter cup is partially filled with an igniter mixture and the end of the pull-wire extends through the igniter cup and is coated with a scratch material. A short section of shrink tubing is positioned over the coated end of the wire to isolate the scratch material. The exposed end of the pyrotechnic composition is covered with an easily ignitable primer material and the outer end of the tubular body is covered with a sealant, coating or membrane to seal the body of the device against moisture or other contaminants. In a second embodiment the igniter system includes a plug formed in the end of the center tube adjacent to the end of the pyrotechnic composition. The end of the pull-wire which passes through the center tube is exposed beyond the plug and is coated with a scratch material and a short section of shrink tubing is positioned over the coated end. Primer material is then formed over the end of the pyrotechnic mixture to completely close and seal the composition. The end of the igniter wire is bent over adjacent to the end of the tube and is then sealed with a membrane or coating to seal the tube against moisture or contaminants. In both embodiments, the pyrotechnic composition and primer remain sealed until the moment the pull-wire is withdrawn and the primer mixture is ignited.

25 Claims, 4 Drawing Sheets

PULL-WIRE IGNITER FOR FLARES

FIELD OF THE INVENTION

This invention is directed to a pull-wire igniter for use with pyrotechnic devices. It is more specifically directed to an igniter using wire type ignition which is used on environmentally sealed, pyrotechnic signal or smoke generating safety type flares.

BACKGROUND OF THE INVENTION

The most common type of pyrotechnic hand held flare is the highway signal flare, which is commonly called a "fusee". Another type of signalling device is the pyrotechnic smoke generating flare. These types of devices are relatively simple in that approximately one half of a hollow, rolled, paper or plastic tube is loaded with a burnable pyrotechnic composition or mixture and topped with a primer button. The burnable mixture is usually formulated to produce a bright flame or generate smoke. Covering the primer button is a striker cap whose outside surface is partially coated with a scratch material. This scratch material is in turn covered with a removable cover to protect the scratch material and seal it from adverse moisture or weather conditions. To ignite this type of flare the user must first remove the cover from the scratch material and remove the striker cap from the flare end containing the primer button. The end of the cover with the scratch material is then rubbed quickly across the primer button to ignite the flare mixture.

This type of igniter system has several major disadvantages. The first disadvantage is the fact that the user must hold the striker cap in the hand in order to rub the scratch material across the primer button. This places the hand very close to the ignition point. This arrangement causes the end of the flare to be directed towards the hand of the user at the time the ignition takes place.

The second disadvantage in this type of device is that the striker cap/primer button system relies on the chemical reaction between the materials in the scratch material and the primer button. This structure requires friction to effect the reaction necessary to ignite the primer button and thus, the flare. Under inclement weather conditions, such as, rain ,snow or marine use, the primer button and/or the scratch material can become subjected to moisture and must be dried in some way before they can be scrapped or scratched together. Although the primer button and scratch material are made to be water resistant, if their surfaces are soaked or saturated, the resulting decrease in available friction makes this ignition system unreliable.

As a result of these disadvantages, it is an object of the present invention to provide a pyrotechnic ignition system that allows the user to ignite a signal device when it is pointed in an outward direction and thus, aimed away from the user. In addition, it is also an object of this invention to provide an ignition system for a pyrotechnic device that will remain sealed and moisture proof until the moment of ignition.

Various other types of igniters for pyrotechnic devices have been attempted. Most of these are quite complex and utilize mechanical springs and levers for triggering the ignition. One of these is for a swimmer distress signal, wherein the ignition system can be operated with one hand. The entire device is housed in a sealed container which must be first removed. Removal of the container exposes a plunger which can be jammed against a solid object to, in turn, ignite the pyrotechnic device. This arrangement operates similar to a firing pin to initiate the combustion.

At the same time, there have been numerous igniters used for detonation of explosive devices. Some of these arrangements utilize a pull-wire having at the opposite end a crimped friction arrangement. This utilizes the draw friction obtained by pulling the wire, coated with a scratch material, through a small cup containing a primer mix. The friction between these two materials as the wire is drawn through it causes the ignition of the primer, which in turn, ignites the pyrotechnic material. This type of igniter has been used on detonators for detonating primacord, and other explosive mixtures.

In the past, pull-wire igniters have not been satisfactory for signaling or smoke generating devices because it was difficult to actually ignite the pyrotechnic burnable mixture of these devices with this type of pull friction igniter. The present invention, however has found a way to solve the problems which have been encountered with the earlier pull-wire igniter devices and now provides new and unobvious results that have not been known before.

INFORMATION DISCLOSURE STATEMENT

The following information is provided in compliance with the inventor's duty to disclose all pertinent information which is relevant to the information which is the subject of this application. The listed patents are known to the applicant and are believed to be pertinent to the examination of this application.

The Martin patent (U.S. Pat. No. 4,846,067) is owned by the applicant and reveals a pull-wire type igniter for safety fuse. This igniter utilizes a crimped wire type friction igniter cup. The igniter cup and the fuse are held in required relative position by a ferrule which produces a reliable ignition. The problems presented by igniting a pyrotechnic burn mixture are considerably different than the problems addressed by the earlier Martin device. As a result, the teaching of this patent does not apply to the invention which is herein disclosed.

The Andrews patent (U.S. Pat. No. 379,147) discloses a friction primer for a blasting or detonating operation. This device shows an elongated wooden tube which has a central longitudinal channel. A pull-wire runs through the channel and out one end of the tube, while at the other end the wire is coiled and embedded in an explosive material. The friction of pulling the wire through the explosive material causes the material to be disturbed so that it will detonate. Although this device shows a pull-wire arrangement, it is not intended for igniting a burnable pyrotechnic mixture which is a requirement of the present invention. Also, this device does not show a channel through the pyrotechnic mixture.

The Norten patent (U.S. Pat. No. 4,493,240) describes an explosive line cutting device which shows a friction pull-wire arrangement. The pull-wire exits the device through a central channel and the friction wire is arranged in conjunction with an igniter cup. The intent of this type of device is to detonate an explosive charge to drive a cutting blade longitudinally through the tube to sever a cord. The problems associated with detonating an explosive are considerably different than the problems which are encountered in igniting the slow burning pyrotechnic mixture associated with a hand signal or smoke generator flare.

The Baker, et al patent (U.S. Pat. No. 3,942,445) discloses a high altitude, friction igniter assembly utilizing a crimped pull-wire. The crimped pull-wire is coated with a scratch sensitive composition or mixture which is pulled through a primer mixture. The compositions disclosed in this patent are intended to provide a flash ignition of a secondary primer to provide the actual ignition of a pyrotechnic composition for high-altitude use.

The Singer, et al patent (U.S. Pat. No. 4,768,439) shows an illuminating type hand flare with the conventional scratch material primer provided at one end of the burnable composition. FIG. 2 of this patent shows a pull-wire igniter for this type of composition which exits the side of the flare. It has been found that this type of igniter positioned adjacent to the end of the pyrotechnic device is an unreliable method for igniting the pyrotechnic composition. On the other hand, the present invention provides a very unique and extremely reliable solution to the problem of igniting a pyrotechnic burnable composition.

The Herold, et al. patent (U.S. Pat. No. 4,805,533) discloses an igniter for use with smoke generators or signal flare type devices which uses a stab primer for ignition. This device discloses a sliding firing pin mechanism that is normally locked in position and protected by a metal cover. A lanyard is used to pull off the cover to expose the firing pin mechanism. A force or impact on the firing pin drives it into the primer to ignite the signal device. This patent discloses a sealed device and the use of a lanyard to remove the protective cover. Other than that, the igniting system is considerably different than that shown, described and claimed by the applicant.

The Michaelis patent (U.S. Pat. No. 333,655) shows a pull-wire igniter for igniting gun powder. This igniter is intended for sealing or plugging the vent hole through which the igniter is inserted to prevent gas from blowing through the vent hole. It includes a centrally positioned pull-wire having a flattened end having serrated edges. The end of the wire is located within a tube in which an igniter mixture is placed. Pulling on the wire causes the igniter to burn which in turn burns the primer material included therein.

The Ballreich, et al patent (U.S. Pat. No. 3,416,450) also shows a pull-wire friction igniter wherein the pull-wire is coiled within a primer mixture. Spherical lead pellets are included for sealing the hole that is exposed when the pull-wire is withdrawn. This igniter is specifically intended for detonating an explosive mixture.

The Beach patent (U.S. Pat. No. 82,586) shows an explosive torpedo for use in oil wells. This device is ignited by a plurality of friction igniters which are ignited by a single pull-wire. The friction igniters in this device are positioned within a centrally mounted tube formed within the explosive mixture.

The Sharp, et al patent (U.S. Pat. No. 549,297) shows a centrally positioned pull-wire used to detonate an explosive cartridge. The pull-wire has an igniter pellet fastened at one end. Withdrawing the pull-wire will cause the igniter pellet to engage a friction surface which will detonate the explosive mixture.

The British patent (189,412) also discloses an igniter for an explosive mixture. This igniter has a cap at each end with one of the caps having a friction surface. The friction surface is rubbed across the friction primer material which in turn ignites a predetermined length of fuse-cord which is selected according to the delayed time required. The cord then fires the detonator to set off an explosive charge. This device provides a timed delay in the ignition of an explosive device and uses a friction type igniter similar to that found on the prior art flares. It is to be noted that all of the last five items discussed above provide igniters for detonating explosive charges. Because of this fact the arrangements disclosed are quite different from the pull-wire igniter for burnable mixture which is shown and described in the present invention.

SUMMARY OF THE INVENTION

This invention consists of a reliable pull-wire igniter device for igniting a burnable pyrotechnic composition. In most cases the burnable pyrotechnic composition or mixture is formulated to produce a colored smoke or intense colored flame and can be formed in a hand held configuration.

Although the body of the device can be formed in many different arrangements, for the sake of illustration, this application will be directed to a tubular hand held configuration. The body of the signaling or smoke generating flare device is formed within a paper or plastic tube having approximately a 1" diameter. A plug usually formed of wood or paper is positioned approximately midway within the tube and one end of the tube is then loaded or filled with a pyrotechnic burnable composition to within ⅛" of the respective end. The opposite end of the tube is left open and forms a hand holding area for the user.

Positioned along the central axis of the tube is a small diameter tube which runs through the composition loaded end of the device. This tubular channel or passageway can be approximately ¼" in diameter and can have the configuration of a common plastic, drinking "straw". If desired, the center tube can extend the full length of the device so as to also extend through the hand held portion of the device. The material and structure of the center tube is important, as will be explained later.

A pull-wire ignition unit or assembly is inserted within the center tube. This unit usually consists of an igniter cup loaded with a primer ignition material and a pull-wire crimped on one end and coated on the crimped end with a phosphorous based scratch mixture. The igniter cup is firmly positioned in the end of the central inner tube and positioned so that it is spaced inwardly from the end of the pyrotechnic composition mixture approximately ½" to 1". The pull-wire is inserted through a hole provided in the cup with the end of the wire extending downward through the center tube. A loop is formed in the end of the wire and a pull cord is tied to the wire loop with the cord extending through the center tube so that it extends past and is exposed at the far end of the device where a button, ring or other suitable object is tied to the end of the cord. Sufficient length is provided for the cord to allow the user to obtain a grip on the cord and object for pulling the wire and igniting the device.

A suitable short length of heat shrink tubing having a suitable diameter is placed over the coated portion of the wire and inside the central channel formed within the end of the pyrotechnic composition. A primer mixture is then arranged to fill the space between the end of the burnable pyrotechnic composition and the end of the outside tube. At the same time that the primer mixture seals the end of the composition, it also extends downward into the central channel partially filling the space between the heat shrink tubing and the pyrotechnic mixture. In this way, the layer of primer mixture forms a lip around the edge of the central channel.

The end of the flare device is sealed with a covering of thin latex, wax, PVC shrink film or other suitable material to render the primer and composition fully sealed and weatherproof. Suitable close fitting, pliable plastic end caps can be positioned over the end of the device to protect the seal and the pyrotechnic mixture and at the opposite end to enclose and support the igniter pull cord. A lanyard interconnecting both end caps can be suitably positioned along the side of the device and releasably attached so that by pulling on the lanyard both end caps can be removed exposing the pull cord so that the device can be quickly ignited.

In order to ignite the flare device, the user grasps the hand portion of the device with one hand and pulls on the available igniter pull cord with the other hand. As the coated portion of the igniter wire is pulled through the igniter cup the resulting friction and chemical reaction causes the igniter material in the cup to ignite. The hot gases and burning flame created by the ignition substantially melts or burns away the seal or waterproof membrane on the end of the device. This heat and gas also expels the shrink tubing exposing the inner walls of the primer composition to the flame. The lip portion of the primer mixture which extends downward into the central channel is in direct contact with the ignition flame causing the primer to quickly reach ignition temperature and ignite. The burning flame of the primer mixture spreads outwardly in all directions from the central channel across the face of the pyrotechnic mixture causing reliable ignition of this mixture As the pyrotechnic mixture burns longitudinally along the body of the device the inner center tube, formed from a suitable plastic material, melts near the progressing flame front and continuously seals the central channel to prevent flame and gases from traveling down through the center tube to prematurely ignite the mixture and endanger the user.

It should be understood that the present ignition system for a burnable pyrotechnic mixture can be utilized in many different devices and is not limited to a hand held device as shown and illustrated in this application. The desired ignition features which are described in this invention can be applied to any device where it is necessary to reliably ignite a burnable pyrotechnic composition.

BRIEF DESCRIPTION OF THE DRAWINGS

Other features of this invention will appear in the following description and claims, reference being made to the accompanying drawings forming a part of this application wherein like reference characters designate corresponding parts in the various views.

DETAILED DESCRIPTION OF THE INVENTION

Figure 1:
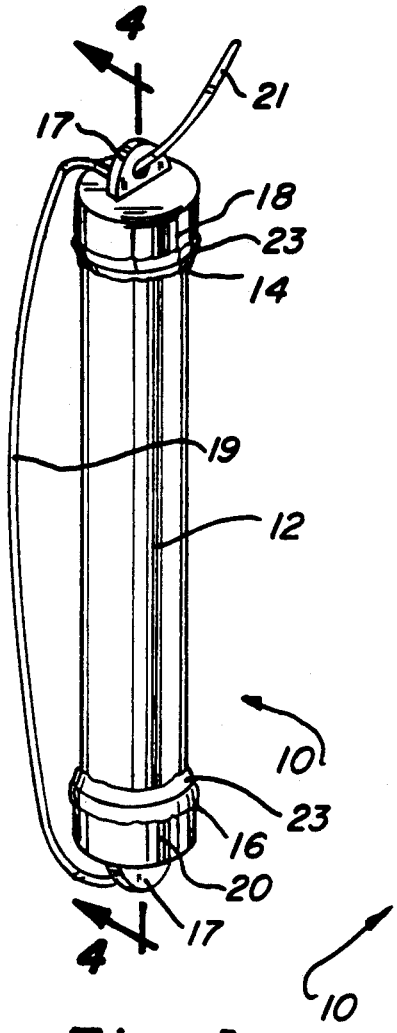
FIG. 1 is a perspective view of a hand held pyrotechnic device which incorporates the pull-wire ignition system of the present invention.

Turning now more specifically to the drawings, FIG. 1 shows a safety signal or flare 10 having an elongated tubular body 12 which in turn has ends 14, 16. End caps 18, 20 cover, protect and seal the respective ends 14, 16 of the tube 12. The end caps 18, 20 can be formed from any suitable soft usually plastic material which can be molded to have a close fitting internal diameter to generally close and seal the ends 14, 16. The purpose of the end caps is to protect the tube and make it relatively weatherproof or moisture proof to seal out any detrimental elements that may affect the shelf life and/or reliability of the overall device 10. If desired, the area around the end caps 18, 20 can be further sealed with a suitable substance 23 such as, wax, shellac or other coating which would aid in the moisture proofing of the overall device. It is also to be understood that the entire body 12 as well as the end caps 18, 20 can also be sealed, such as, by spraying or dipping to effect the desired moisture proof or waterproof structure. If desired, just one end cap can be used and placed on the end which needs the most protection.

Figure 2:
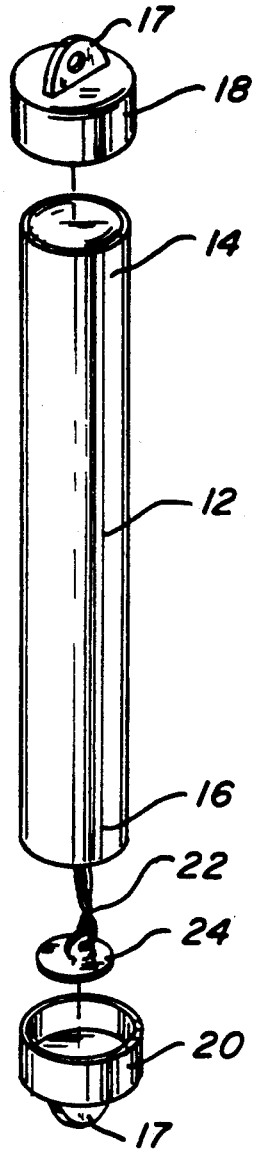
FIG. 2 shows the same pyrotechnic device as shown in FIG. 1 with the protective end caps removed and the ignition pull cord exposed.

An eyelet 17 or other fastening device can be provided either in or on the outer surface of the end caps 18, 20 which will allow the connection of a lanyard 19 which can extend between the end caps with the lanyard end 21 removably attached to the side of the body 12. In this way, by grabbing hold of the end 21 of the lanyard with one hand and pulling toward away from each end of the body the end caps 18, 20 can be easily removed in essentially one motion. FIG. 2 illustrates the removal of the end caps 18, 20 which exposes the protected pyrotechnic materials which are loaded into a portion of the body 12 and exposed within the end 14 of the tube The other end of the tube 16 houses a slack pull cord 22 to which a gripping button or rather large object 24 is securely attached. The removal of the cap 20 allows the cord 22 and button 24 to extend beyond the end 16 of the tube 12 so that it can be easily grasped by the hand of the user.

Figure 3:
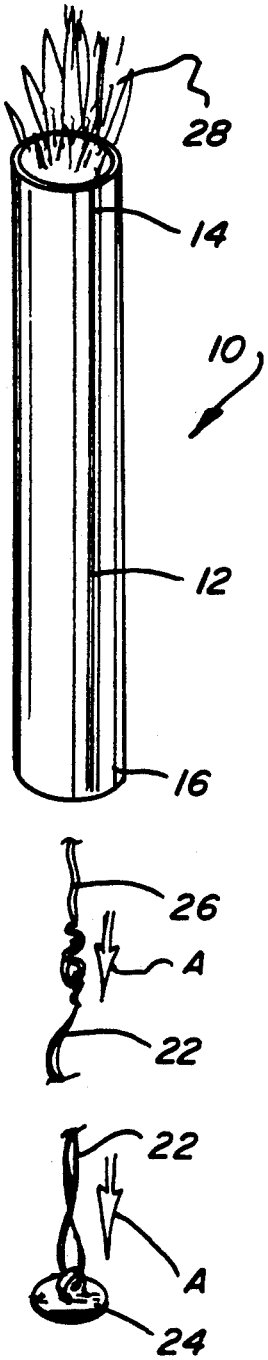
FIG. 3 shows the pyrotechnic device of FIG. 2 wherein the pull cord has been withdrawn causing the pull-wire ignition system of the present invention to ignite the pyrotechnic composition within the device.

FIG. 3 shows the next step in the operation of the smoke generating or signaling device as provided in the present invention. Pulling the cord rapidly away from the body of the device, in the direction of the arrows A, causes the pull cord 22 which is connected to a friction ignition wire 26 to be withdrawn through an ignition cup embedded within the pyrotechnic material loaded within the inner portion of the tube 12. This motion causes the igniter to generate a quick burning flame which in turn ignites the primer and pyrotechnic mixture which is provided within the tube 12. As can be seen in this figure, the exposed burning end of the pyrotechnic material produces a bright flame or smoke generation which is desired in a distress or signalling device of this type. This burning continues for a predetermined period of time depending upon the amount of material that is present.

It should be noted that the entire device can be ignited in a simple two step process wherein the end of the signalling device can be easily pointed in a direction away from the user's body during the igniting process. This process accomplishes one of the prime objectives of the present invention which is to safeguard and prevent accidental injury to the user during ignition. The other primary objective is to provide a reliable ignition system for a distress or signalling device of this type which can remain substantially sealed from adverse moisture or weather conditions up to the instant that the signal flare or smoke generator is ignited.

Figure 4:
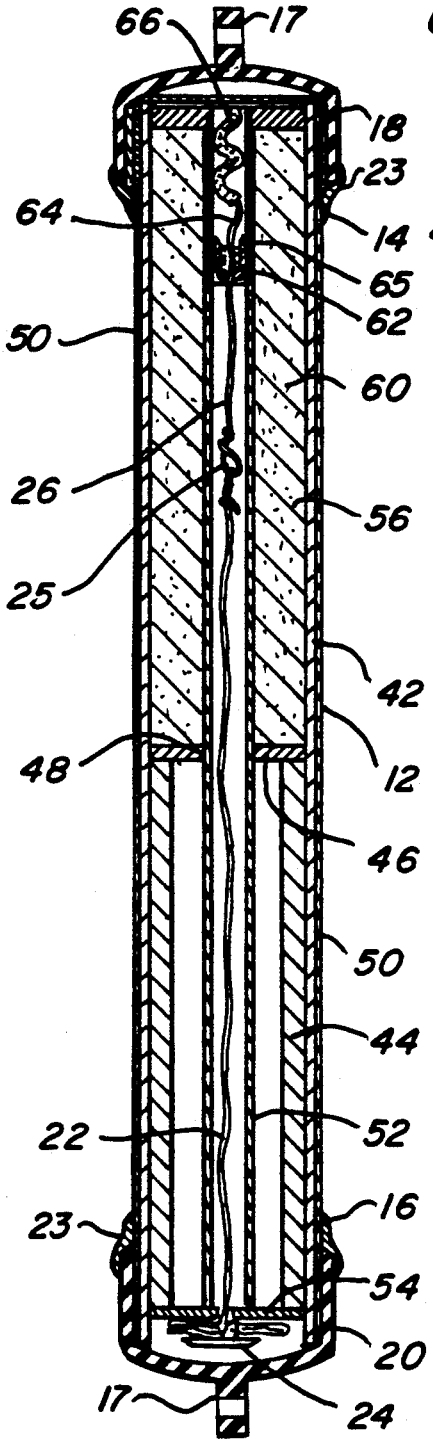
FIG. 4 is a cross-sectional view taken along the lines 4—4 of FIG. 1 which shows the pyrotechnic composition and the preferred pull-wire ignition system according to the present invention.

FIG. 4 shows the internal features of the pyrotechnic device 10 according to the present invention. The outer body 12 is a relatively substantial cylindrical, hollow tube 42. It can be formed from paper, plastic, metal or any other suitable material that may or may not burn or be consumed during use. In the preferred embodiment, the outer tube 42 is formed from spiral wound or wrapped paper which can be formed in a multi-layer configuration wherein the layers are held together with a suitable adhesive. In this way, a relatively strong hollow tubular structure is provided. In this configuration, the paper will be consumed during the ignition and burning of the pyrotechnic composition so that it is dissipated and will not interfere with the desired signalling function of the device. In most cases the outer diameter of the paper tube 42 is approximately 1" while the length can be of any desired dimension for the required burn time with a nominal dimension of approximately 7".

The elongated hollow tube 42 inherently has an interior cavity 56 which is at least partially loaded with a suitable burnable pyrotechnic composition or mixture, which will provide the desired signally characteristics. Although various pyrotechnic burn mixtures are well known in the industry it is feasible that the manufacturer can provide other signalling functions by the addition of certain chemicals or objects which will impart various colors or other significant characteristics to the burn results. One characteristic might be a "roman candle" effect for the signalling function.

It is very important that the pyrotechnic mixture be properly compacted and formed during the loading process in order to obtain a continuous and reliable burning of the mixture. As part of this invention the applicant has discovered that it is possible to modify the common auger type loading device for loading the flare tubes so that the mixture is properly compacted and a central elongated passageway is simultaneously formed through the pyrotechnic mixture or composition.

Figure 9:
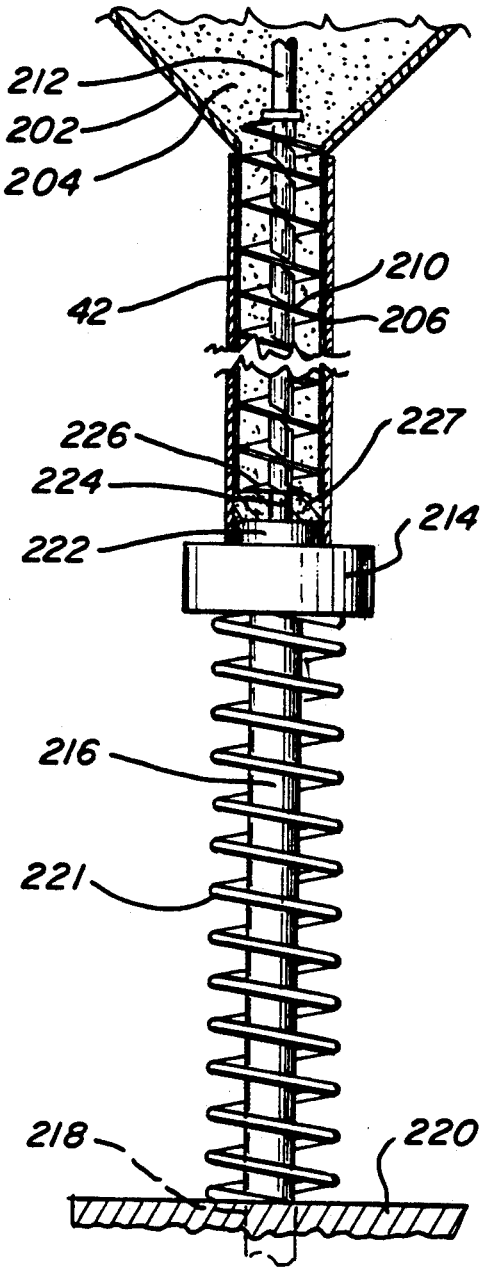
FIG. 9 is a pictorial cross-sectional view of a unique auger loading system for pyrotechnic flares.
Figure 10:
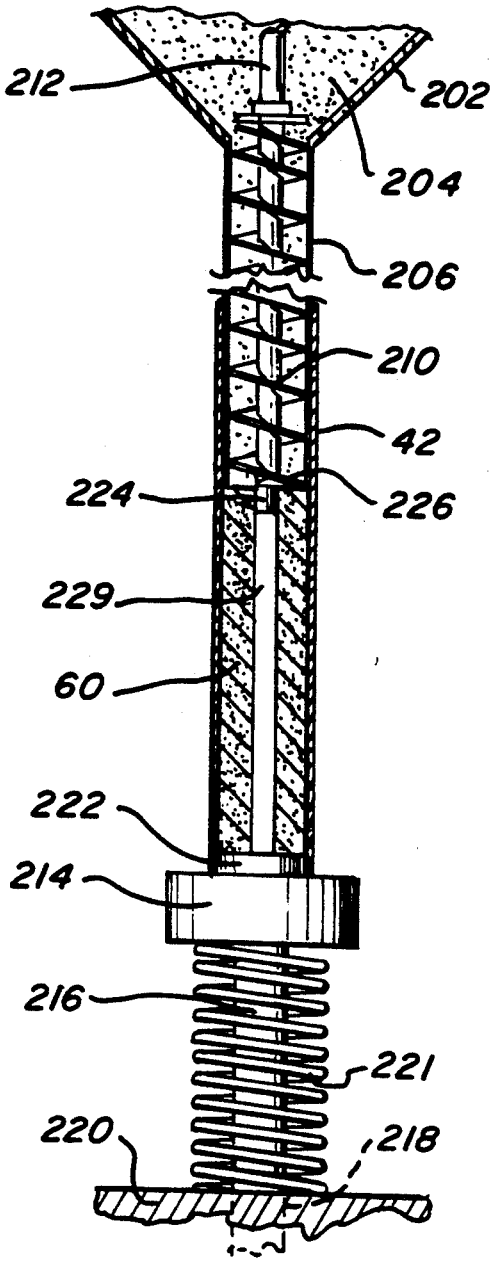
FIG. 10 is a pictorial cross-sectional view showing the loaded flare having a central passageway formed through the composition.

As shown in FIGS. 9 and 10, a funnel shaped hopper 202 is properly mounted on a suitable structure and is filled with a granular or pliable pyrotechnic composition or mixture 204. Elongated fill tube 206 extends downward from the hopper 202. The fill tube 206 is usually fabricated from a thin stainless steel material and has a length which is at least greater than the length of the flare tube 42 that is to be filled. A rotating auger 210 which is suitably mounted on a drive shaft 212 is suspended within the interior of the fill tube 206. A support plug or ram 214 having a diameter which is greater than the body tube 42 is mounted on a guide shaft 216 which can be guided through an aperture 218 located within a support structure 220. A helical spring 221 or other suitable biasing arrangement may be provided for providing an upward consistent force of approximately thirty pounds. This is to say that a downward force of approximately thirty pounds on the support plug 214 will move the plug downward in a linear direction with respect to the fill tube 206 and auger 210. A center guide recess plate 222 is centrally affixed on the upper surface of the support plug or ram 214. The outside diameter of the guide plate 222 is sized to fit the inside diameter of the flare body tube 42.

The height of the guide plate 222 is approximately ⅛" which will provide a recess of the same dimension between the loaded pyrotechnic composition and the end of the body tube 42. It is understood that the height of this plate can be any dimension as desired for the recess required in the finished flare.

A novel feature of the present invention is the addition of a stud or pin coaxially mounted on the end of the auger 210. This cylindrical pin is approximately ¼" in diameter and is approximately ¼" to ⅜" long. It extends below the end 226 of the auger 210 and rests upon the upper surface of the guide plate 222 mounted on the support plug 214. It is also noted that the end of the fill tube 206 corresponds with the end 226 of the auger 210. The body flare tube 42 which closely fits the outside diameter of the fill tube 206 merely rests by gravity against the upper surface of the support plug or ram 214 and is held in centered position by the plate 222. As can be seen, the inside surface of the flare body tube 42 is exposed in the area between the upper surface of the guide plate 222 and the end of the fill tube 206 and auger 210. This exposed area is important and will be explained below.

The purpose of the present auger arrangement is to automatically and simultaneously form a center tunnel or passageway through the compacted and loaded pyrotechnic composition or mixture 60.

In operation, the pyrotechnic burn mixture 204 is moved downwardly through the hopper 202 by the rotating movement of the auger 210. This direct feed of the pyrotechnic burn mixture 204 by the auger motion causes the material to firmly pack into the cavity or space 227 between the inside surface of the flare body tube 42, the bottom edge 226 of the auger 210 and the upper surface of the guide plate 222. This material continues to be packed or loaded into this space by the rotation of the auger until a desired density is obtained. At the same time, the mixture 204 is packed around the center pin 224 until the mixture reaches the desired compaction and the continued rotation of the auger produces a downward force on the mixture which exceeds the upward force of the spring 221 or biasing device which is nominally set at approximately thirty pounds. It has been found that a thirty pound compaction of the pyrotechnic burn mixture is usually sufficient to produce the desired reliable results in the burning of the signal flare device. As the auger 210 continues to force additional mixture into the space 227, the support plug or ram 214 is forced downward and with the friction of the burn material packed tightly against the inside surface of the flare body tube 42 the flare tube moves downwardly with the support plug 214. Continued compaction of additional pyrotechnic burn mixture at the end 226 of the auger 210 causes the new material to be properly packed and the tube 42 and support plug 214 to move continuously in a downward direction. The center pin 224 is constantly rotated during the compaction process and forms a center tunnel or passageway 229 within the precisely shaped and loaded pyrotechnic burn mixture 60.

Figure 11:
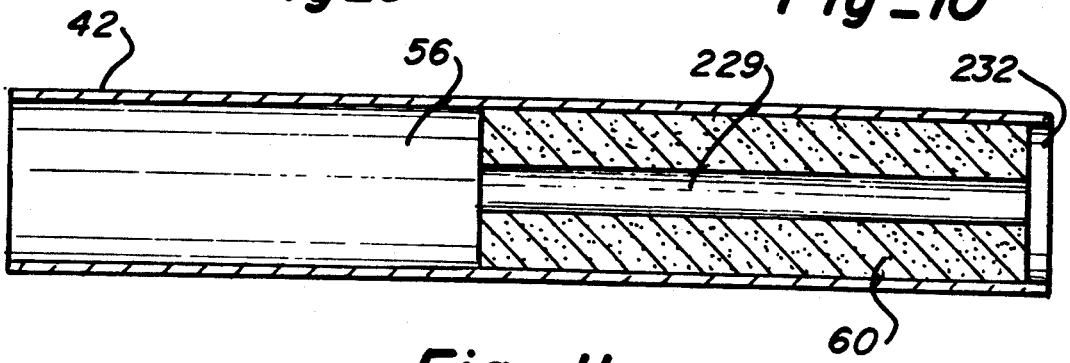
FIG. 11 is a cross-sectional view of the loaded flare tube.

The rotation of the auger continues the loading and compaction process and the formation of the center tunnel or passageway 229 until the desired length for the pyrotechnic mixture 60 is obtained. Usually this mixture is loaded to a point which is approximately 4" from the opposite end of the body tube 42. As can be seen in FIG. 11 a recess 232 of approximately ⅛" is formed between the end of the pyrotechnic burn mixture 60 and the end of the body tube 42. The purpose of this recess will be explained later.

As outlined above, the outer body tube 42 partially filled with the burnable pyrotechnic composition or mixture 60 has a remaining open or hollow portion 56 at end 16. This end can be used as a hand hold area which can be readily gripped and supported by the user. In the present and preferred embodiment a rigid hollow tube 44 also fabricated from paper or any other suitable material can be positioned within the hollow portion 56 of the tube 42. This rigid tube can be approximately 4" in length and provides a strengthening or reinforcing function for the hand hold area of the tube 42. A flat disk or plug 46 can be positioned within the tube at the upper end of the rigid inner tube 4 and held in position by adhesive or any other fastening arrangement. The flat disk 46 is usually placed in direct contact with the end of the loaded portion of the pyrotechnic mixture 60. A central opening 48 can be provided within the disk 46 to correspond with the inner passageway 229 through the mixture 60. The outer end of the inner tube 44 is recessed slightly inward from the edge of the outer end 16 of the body tube 42.

Although it is not absolutely necessary, an outer wrapper or plastic label 50 can be provided to surround the outside surface of the tube 42 to provide an additional moisture or waterproof barrier for the overall tubular body 12 and to possibly improve the appearance and salability of the device.

A small diameter elongated hollow tube 52 having an outer diameter which is approximately the same as the inner diameter of the tunnel 229 is coaxially mounted within the tubular body 12 and is forcibly inserted substantially through the tunnel 229 centrally located within the pyrotechnic mixture 60. This center tube 52 provides an internal passageway or channel through the tunnel 229 and can extend the entire length of the flare body tube 42. The center tube 52 provides a lining along the inside surface of the tunnel 229 through the pyrotechnic mixture 60. The lower end of the center tube 52 is positioned adjacent to the end of the inner tube 44 and both these tubes can be closed with a flat disk or closure which can be fixedly mounted on the ends of the inner and outer tubes. A small central opening communicating with the internal passageway of the center tube 52 is provided.

The opposite end 65 of the center tube 52 is recessed approximately ¾" to 1" from the end 14 of the outer tube 42. This leaves the end 65 of the center tube 52 recessed approximately ⅝" to ⅞" from the end of the burnable pyrotechnic mixture 60. The center tube which is inherently coaxially positioned within the tubular body 12 is fabricated from a suitable material, such as plastic, which will partially melt or deform when subjected to high temperatures whereby during use when the pyrotechnic material is burning the end of the center tube 52 will essentially close off and plug the center passageway. The actual outside diameter of the center tube is predetermined so that it will closely fit the inside diameter of the tunnel 229. The inside dimension of the tube 52 is sized to allow the free activation and withdrawal of the pull-wire which is part of the present invention.

An igniter cup 62 which is generally well known in the industry is inserted through the open passageway 229 provided within the mixture 60 to a point where the igniter cup 62 is seated firmly within the end of the center tube 52. The igniter cup 62 is open at the outer end and is at least partially filled with a suitable igniter mixture. The pull-wire 26 passes through an opening provided in the bottom of the cup 62 with the upper end 64 of the pull-wire 26 either left straight, slightly bent or is crimped in a zigzag configuration. The upper end 64 of the pull-wire 26 is coated with a suitable scratch mixture 66 which adheres to the wire itself. It is understood that in some cases the igniter cup 62 and the coated pull-wire 26 along with the attached pull cord 22 can be assembled as a unit and the unit is then inserted into the passageway and the center tube 52 of the device at one time. After the pull-wire igniter cup unit is inserted and properly seated, a short section of conventional shrink tubing 68 having a proper diameter is then inserted over the coated end 64 of the igniter pull-wire 26 so as to protect it from actual contact with the pyrotechnic mixture 60. The diameter of the shrink tubing 68 is such that it will easily slip over the coated end 64 and yet be easily inserted into the central tunnel or passageway 229 formed within the pyrotechnic mixture or composition 60. In many cases the pyrotechnic composition 60 must be finally baked or heat cured to obtain the proper consistency and at that time the shrink tubing 68 will contract to more closely fit the coated end 64 of the pull-wire 26. It is also noted that the shrink tubing 68 is normally manufactured from a fire resistant material so that it will not burn during the ignition.

Once the igniter cup unit or assembly and the shrink tubing is properly inserted a suitable primer mixture 70 is then painted or poured over the end of the pyrotechnic composition 60 where it will set to a solid consistency so as to cover and seal the end of the mixture 60. Any primer mixture can be used which will easily ignite and burn and in turn ignite the particular pyrotechnic composition which is utilized in the device. At the time that the primer mixture 70 is placed over the end of the pyrotechnic composition 60, a portion of the primer material 70 flows downward into the central passageway 229 and along the inside surface of the composition 60. This action forms a circumferential lip 72 between the shrink tube 68 and composition 60. The position of the primer mixture 70 along with the lip 72 is very important to obtain the high degree of reliable ignition that is obtained with the present invention.

Figure 5:
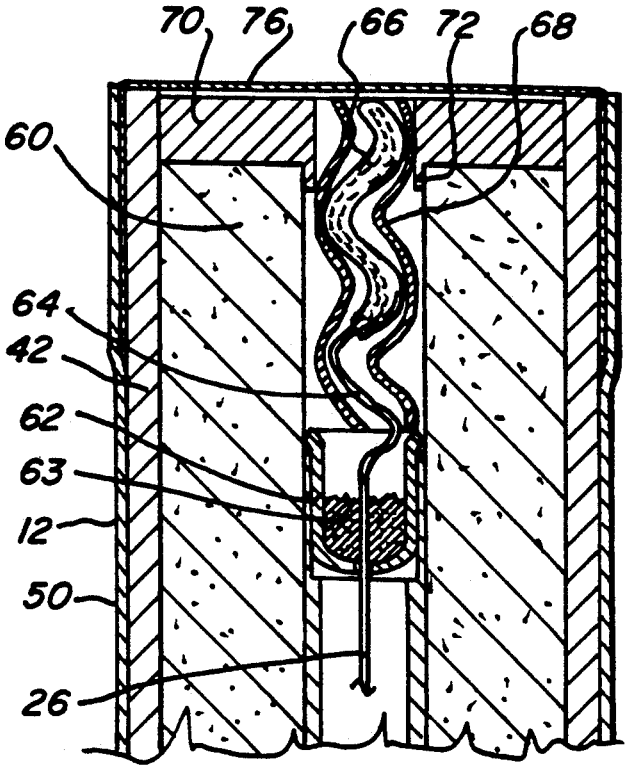
FIG. 5 is a detailed cross-sectional view of the device of FIG. 4 showing the igniter cup and coated ignition pull-wire.

Once the placement of the primer mixture 70 is completed, the end of the tubular body 12 can be permanently sealed to prevent the introduction of moisture or other contaminants. This seal can be a suitable membrane or coating 76 which can be of any material, such as latex, wax, PVC shrink film, plastic or any other suitable material which will seal the primer and internal components. One arrangement which has found to work quite satisfactorily is the use of a short piece of PVC shrink film or tube which is closed at one end. The tube is positioned over the end of the tube 42 and with the application of heat it shrinks to tightly form a seal over the end of the tube. In this arrangement the seal can be positioned as shown in FIG. 5 to extend downward over the outer surface of the tube 42 and possibly between the tube 42 and the outer label or sleeve 50, if desired. The addition of the protective end cap 18 over the end 14 of the tubular body member 12 further aides in protecting the seal as well as helping to seal out moisture and other contaminants.

Figure 6:
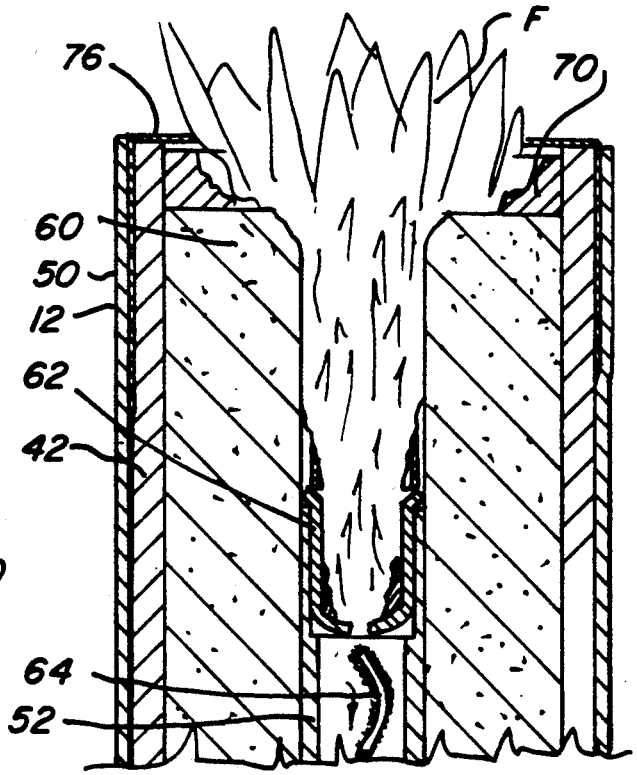
FIG. 6 shows the same close up sectional view as seen in FIG. 5 with the pull-wire removed and the primer mixture burning.

In operation as shown in FIGS. 3 and 6 the removal of the protective end caps and the rapid withdrawal of the cord 22 and the attached pull-wire 26 from the end of the tubular body member 12 causes the end 64 of the wire 26 to be pulled and straightened as it passes through the igniter cup 62. The contact of the scratch mix 66 with the igniter mixture 63 causes an intense flame and the generation of a considerable volume of gases. This flame instantaneously burns through the seal or coating 76 to expose the end of the central passageway to the atmosphere. The gases that are generated instantaneously expel the shrink tubing 68 that remains in the passageway. The intense flame from the igniter mixture 63 extends up through the central passageway to contact the lip 72 and inner surface of the primer 70. This flame contact on the primer mixture 70 rapidly ignites the primer mixture which in turn burns outwardly across the end surface of the pyrotechnic composition 60 causing ignition of this mixture. The burn pattern of the pyrotechnic composition then is downward from the outer end 14 of the tubular body. The progression of the burn pattern of the composition mixture 60 proceeds to the igniter cup which is expelled or discarded with the advancing flame front. The approaching heat on the end of the center tube 52 causes the tube material to partially melt as the temperature increases which in turn closes the passageway provided within the center tube 52. This controls the intense flame at the end of the distress or signalling device 10 and prevents it from passing downwardly through the center tube where it could prematurely ignite the body of the pyrotechnic composition 60 or exit through the opposite end where it could burn and injure the user's hand.

Figure 7:
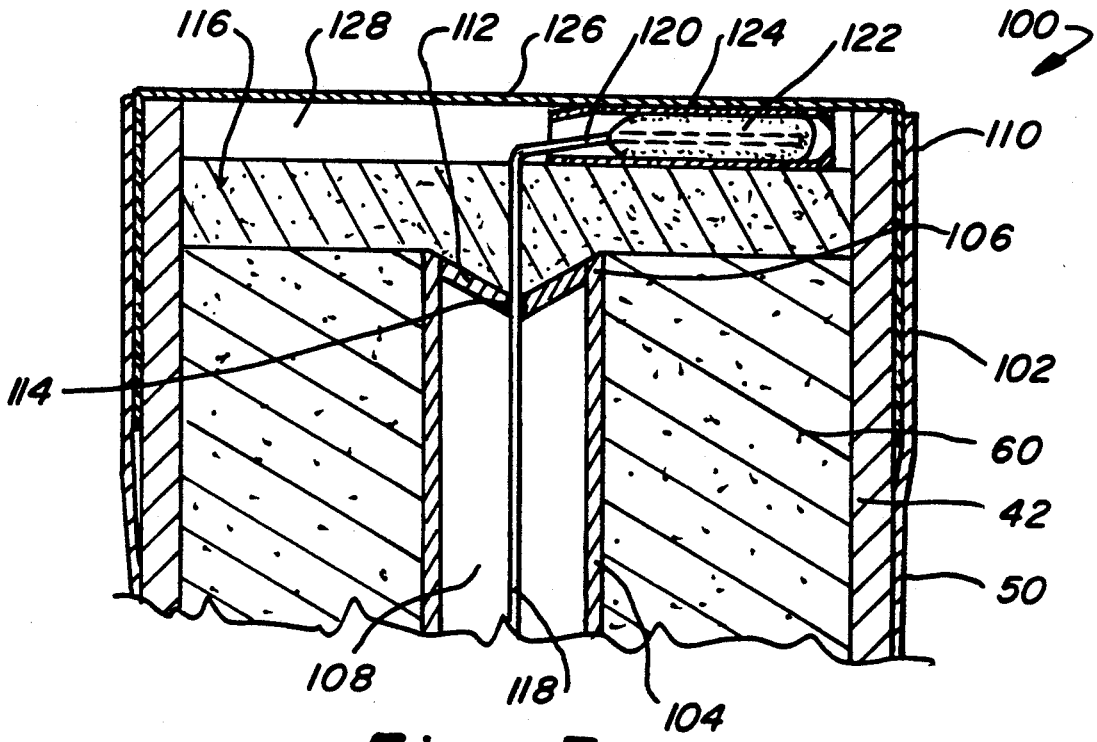
FIG. 7 shows a detailed cross-sectional view of another embodiment of the pull-wire ignition system according to the present invention.
Figure 8:
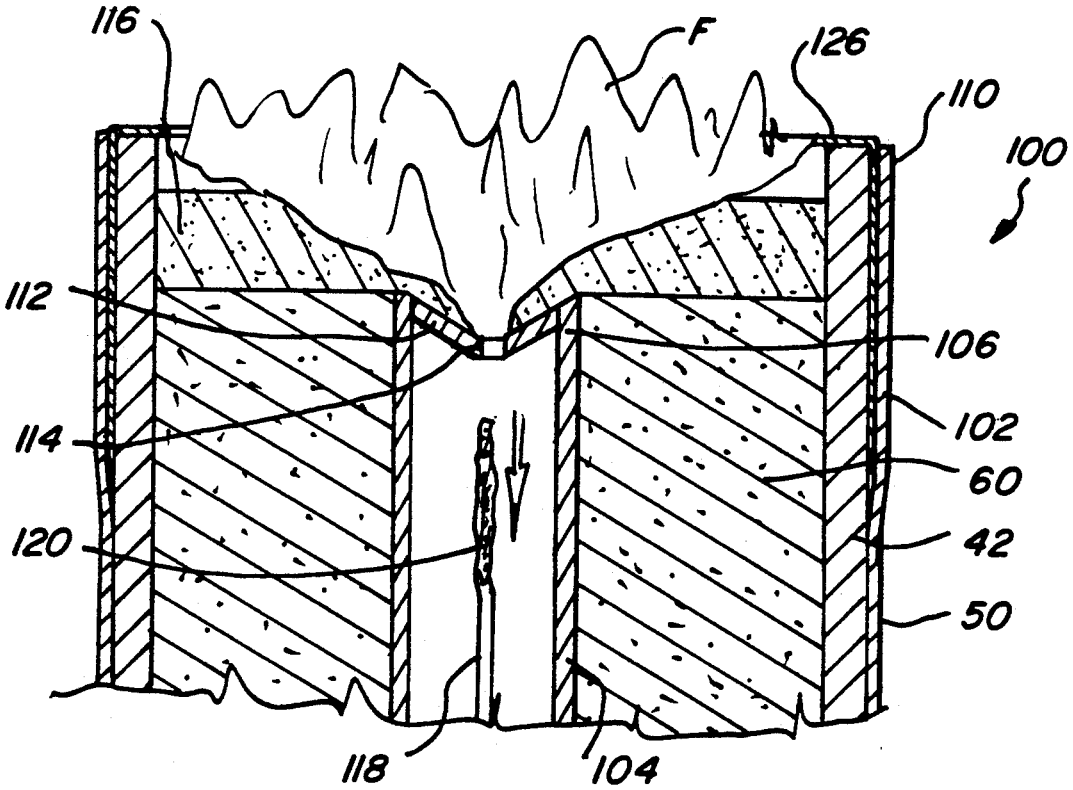
FIG. 8 is a detailed cross-sectional view of the embodiment shown in FIG. 7 wherein the igniter pull-wire has been withdrawn causing the ignition of the primer mixture.

FIGS. 7 and 8 show another embodiment of the pull-wire igniter for distress and signalling devices according to the present invention. The flare device 100 according to this embodiment includes the same basic features of the earlier described preferred embodiment except for some modifications with respect to the pull-wire igniter assembly. The device 100 according to this embodiment includes the outer tube 42, outer sleeve or label 50 on the outer surface of the outer tube 42, pyrotechnic composition 60 and center tube 104. The center tube 104 is identical to the center tube 52 in the earlier embodiment except that the end 106 extends upwardly through the central passageway 108 provided within the composition to a point essentially even with the upper end of the pyrotechnic composition 60. This point is actually recessed approximately $\frac{1}{8}$" to $\frac{1}{4}$" below the outer end 110 of the tubular body 102. A relatively solid end cap 112 having a center opening 114 is positioned at the end 106 of the center tube 104. The end cap 112 converges at an angle towards the center of the passageway 108.

A pull-wire 118 having an end portion 120 is positioned so that the opposite end extends through the opening 114 into the center tube 104 where it is attached as previously described to the pull cord 22. The pull cord in turn is connected at its opposite end to the button 24 to allow the pull cord and pull-wire to be easily withdrawn. The opposite end portion 120 of the pull-wire 118 which can be crimped is coated with a suitable phosphorous scratch mix which when rapidly placed in contact with the primer material will cause direct ignition of the primer material. A relatively thick layer of primer material 116 is cast or poured over the entire end of the pyrotechnic composition 60 where it hardens or solidifies to form a solid cap.

Once the primer material 116 is set the pull-wire 118 is bent over at the surface to an acute angle and the coated end 120 of the pull-wire 118 is sheathed with a short section of shrink tubing 124. The end of the pull-wire with its friction or scratch coating and the shrink tubing is relatively flat and is sized to easily fit within the space 128 provided between the primer material 116 and the end 110 of the outer body tube 42. The purpose of the shrink tubing is to isolate the scratch coating 122 on the end of the pull-wire 118 to prevent any premature contact with the primer material 116 which might ignite the device. Thus, a factor of safety is built into the igniter assembly provided in this invention.

As explained earlier a seal which can be a membrane or coating 126 formed from latex, wax, PVC shrink film or any other suitable material is formed over the end space 128, shrink tubing 124, and the outer surface of the primer mixture 116. The membrane or coating can extend down over the sides of the outer tube 42 to properly seal the end against any moisture or contamination. This membrane also holds the end 120 of the pull-wire 118 in a relatively rigid position to prevent extraneous movement.

In operation, which is similar to the earlier embodiment, the pull cord and attached pull-wire 118 is rapidly pulled through the central passageway 108 which quickly moves the end 120 of the pull-wire 118 along with the friction sensitive coating 122 down through the center portion of the primer mixture 116 and through the opening 114 in the end cap 112. This rapid movement of the friction sensitive coating 112 along with the bending motion of the pull-wire as it is pulled through the primer mixture 116 causes the ignition of the primer material as shown in FIG. 8. The outward moving flame front of the burning area F in this embodiment causes the pyrotechnic mixture 60 to ignite producing the distress or signalling function. All other features of this embodiment such as the partial melting and closing of the center tube during the burning process are essentially the same as that described in the earlier embodiment.

It is to be understood that the chemical compositions for the various pyrotechnic mixtures as well as the primer and igniter mixtures can be selected from any of the many compounds which are essentially known in the pyrotechnic industry. These mixtures do not form a part of this invention. Any type of chemical compounds or mixtures which are suitable for the intended purpose can be utilized in this invention. It is also important to note that the shrink tubing which is described herein is usually made from a flame resistant type of material. Thus, the tubing remains relatively intact and is completely expelled from the device by the gases which are generated. Use of a fire resistant material is desirable to insure that the tubing is not burning when expelled from the device to prevent any unwarranted fire hazard to the surrounding area.

Although a reliable pull-wire igniter for pyrotechnic distress or signalling devices has been shown and described in this application, it should be understood that this invention is not to be limited to the exact form disclosed, and changes in detail and construction of the invention may be made without departing from the spirit thereof.

What is claimed is:

1. A hand held pyrotechnic signalling device for producing a bright flame or generating smoke, said device comprising;

a) a hollow tubular body means, said body means having a means within said body means to separate said body means into two end sections, a first end section being of sufficient length to serve as a hand gripping area for the device and a second end section being filled with a suitable burnable pyrotechnic composition, said composition being filled to form an exposed end which is recessed a predetermined distance within the second end section of the body means, the exposed end of the pyrotechnic composition being at least partially covered with a primer mixture for igniting said composition;

b) an elongated hollow center tube means is positioned coaxially within said body means whereby a central passageway is provided through at least the composition filled second end section of the body means;

c) a pull-wire igniter means is arranged in conjunction with said center tube means, said pull-wire igniter means includes a pull-wire means for initiating the pull-wire igniter means, said pull-wire means being arranged to extend through the center tube means and have sufficient length to extend beyond the end of said first end section of said body means; and d) said pull-wire igniter means having a section of shrink tubing arranged to at least partially cover the pull-wire igniter means to isolate the pull-wire means from the composition and primer mixture to prevent premature ignition of the pull-wire igniter means and said composition.

2. A signalling device as described in claim 1 wherein the primer mixture and the end of the second end section of the body means is covered with a sealing means to seal the end of the tubular body means to prevent the introduction of moisture or other contaminants.

3. A signalling device as defined in claim 2 which further includes at least one pliable sealing end cap, said end cap having an inside diameter which closely fits the outside diameter of the body means, said end cap being positioned over the end of a end section of said body means to seal the end section of the body means.

4. A signalling device as defined in claim 3 wherein a pair of end caps are provided for covering the ends of the end sections, and said end caps are interconnected by a lanyard means, said lanyard means having a free end whereby the user can grasp the free end of the lanyard means and by pulling on the lanyard means can quickly remove both end caps prior to use of the signalling device.

5. A signalling device as defined in claim 4 wherein said body means with the attached end caps is sealed by applying a coating of sealing material to the end caps and the adjacent portions of said body means to more completely seal the body means.

6. A signalling device as defined in claim 1 wherein the pull-wire means includes a thin bendable wire having a first and second end, a crimped portion is formed in the first end of said wire means and said crimped portion is coated with a pyrotechnic scratch mixture, and said second end is connected to a pull cord which passes through the center tube means and has sufficient length to extend beyond the body means whereby it can be grasped and pulled by the user.

7. A signalling device as defined in claim 6 wherein the extended end of said pull cord is attached to an object to allow a user to securely grip the end of the pull cord.

8. A signalling device as defined in claim 6 wherein a pliable end cap is positioned over the first end section of said body means so as to seal the first end section of the body means and to enclose and store the pull cord.

9. A signalling device as defined in claim 1 wherein the center hollow tube means extends through the first end portion of the body means, and a closure means having a center opening is fixedly attached to the end of the body means and center tube means to hold these elements in relative, rigid position.

10. A signalling device as defined in claim 1 wherein an end of the center tube means which corresponds with the second end section of the body means is recessed a predetermined distance within the central passageway from the end of the second end section, and said pull-wire igniter means includes an igniter cup containing a primer mixture, said igniter cup is positioned within said central passageway and within the recessed end of said center tube means, the pull-wire means of said pull-wire igniter means being arranged to pass through said igniter cup and having a crimped portion at one end which is positioned within the exposed central passageway with an opposite end of the pull-wire means extending through said center tube means to a point beyond the end of the first end section where it is easily grasped by a user so as to ignite the signalling device, said crimped end of the pull-wire means includes a coating of a suitable scratch mixture and said shrink tubing is positioned over said coated crimped end of the pull-wire means so as to isolate the scratch mixture from the pyrotechnic composition.

11. A signalling device as defined in claim 10 wherein the end of said pull-wire means positioned within said center tube includes a pull cord which has sufficient length to extend beyond the first end portion of the body means and the extended end of said pull cord is attached to a gripping object which will allow the user to obtain a secure grip on the pull cord so that the pull-wire means is withdrawn through the igniter cup causing the ignition of the primer mixture and pyrotechnic composition.

12. A signalling device as defined in claim 1 wherein the primer mixture within the second end portion of the body means partially extends into said central passageway into an area between the shrink tubing positioned in the central passageway and the pyrotechnic compound so as to form a lip at least partially around the central passageway to aid the pull-wire igniter means to ignite the primer and pyrotechnic composition to provide a reliable ignition for the signalling device.

13. A signalling device as defined in claim 1 wherein an end closure is positioned over the end of the center tube means adjacent to the end of the pyrotechnic composition and a center opening is provided within said end closure, the pull-wire means of said pull-wire igniter means extends through the opening in said end closure and an outer exposed portion of the pull-wire means is coated with a suitable scratch mixture, an opposite end of the pull-wire means extends through the center tube means and beyond the end of the first end section of the body means whereby it is grasped by the user, the crimped end of said pull-wire means is bent at an angle to lie adjacent to an outer surface of said primer mixture and the shrink tubing is positioned over the coated end of said pull-wire means to isolate the coated end from the primer mixture.

14. A signalling device as defined in claim 13 wherein a sealing means is provided over the second end section of the body means whereby the interior contents of the second end section of the body means and remains sealed until the moment of ignition of the signalling device is sealed to prevent the introduction of moisture or contaminants.

15. A signalling device as defined in claim 14 wherein said pull-wire means includes a pull cord attached to the end of said pull-wire means positioned in said center tube means, the length of said pull cord is sufficient to extend beyond the end of said first end portion of the body means and the extended end of said pull cord is attached to a suitable object whereby the object and pull cord is securely gripped by the user to initiate the pull-wire igniter means and ignite said signalling device.

16. A signalling device a defined in claim 1 wherein said center tube means is formed from a suitable plastic material whereby as a flame front produced by the burning of the pyrotechnic composition approaches the center tube means the plastic material will melt and deform to substantially seal and close the central passageway to prevent flames and gases from passing through the central passageway which could endanger or injure a user.

17. A pull-wire igniter for a hand held pyrotechnic signalling device, said signalling device having an elongated, tubular body means having a first end section which can be used as a hand gripping area by a user and an opposite second end section which is filled with a suitable pyrotechnic composition leaving an exposed outer end portion, the outer end portion of said composition is coated with a suitable primer mixture, said second end section of the body means having a coaxially positioned central passageway extending through the pyrotechnic composition, said pull-wire igniter comprising;

a) an elongated hollow center tube positioned within said central passageway to line the passageway and support the pyrotechnic composition;

b) a length of thin, bendable, igniter pull-wire having first and second ends;

c) the first end of said igniter pull-wire being coated with a suitable scratch mixture and a short section of shrink tubing is positioned over the first end of said wire and said scratch mixture coating;

d) said pull-wire and a suitable igniter mixture are positioned within the center tube and the central passageway formed within said pyrotechnic composition and adjacent said primer mixture whereby when the second end of said pull-wire is quickly drawn through the center tube the first end of said pull-wire and said scratch mixture will come into rapid contact with said igniter mixture thereby igniting the primer mixture and the pyrotechnic composition within said body means so as to produce a bright flame or generate smoke for signalling purposes; and said center tube is formed from a plastic material whereby as the pyrotechnic composition burns it produces an advancing flame front which causes the plastic center tube to melt and deform closing off the center tube to prevent flame and gases from passing through the center tube to prevent injury to a user.

18. A pull-wire igniter as defined in claim 17 wherein the first end of the pull wire is bent in a crimped configuration.

19. A pull-wire igniter as defined in claim 17 wherein the igniter mixture is positioned within an open igniter cup, and said igniter cup is positioned within the end of the center tube and within the central passageway formed in the pyrotechnic composition.

20. A pull-wire igniter as defined in claim 17 wherein the igniter mixture is the primer mixture, and said first end and scratch mixture coating of said pull-wire is positioned adjacent to the primer mixture and arranged so that pulling on the second end of the pull-wire will cause the first end and scratch mixture to be pulled through a portion of the primer mixture so as to ignite the primer mixture and in turn the pyrotechnic composition.

21. A pull-wire igniter as defined in claim 20 wherein said pull-wire is positioned within said center tube with the first end of said pull-wire extending beyond an outer surface of the primer mixture, said first coated end is bent at an angle so as to lie adjacent to the outer surface of said primer mixture, and the shrink tubing is positioned over the coated end of the pull-wire to prevent ignition of the primer mixture through premature contact with the coated end.

22. A pull-wire igniter as defined in claim 21 whereby the second end section of the body means is enclosed by a sealing means so that the coated end of the pull-wire and shrink tubing are firmly held in position and the end is sealed to prevent the introduction of moisture or contaminants.

23. A method for making a pyrotechnic signalling device for producing a bright flame or generating smoke, the method comprising;

a) forming an elongated, hollow tubular body;

b) filling at least one half of said tubular body with a suitable pyrotechnic burnable mixture and forming a layer of primer mixture over an exposed end of said pyrotechnic composition;

c) forming a central passageway through said pyrotechnic composition and positioning a thin plastic center tube within said central passageway, said center tube being sized to closely fit the internal diameter of said central passageway, said center tube having a first end positioned near an exposed end of said pyrotechnic composition and a second opposite end;

d) positioning a pull-wire igniter device within the first end of said center tube with a portion of the pull-wire igniter device extending through the center tube so that it is exposed at the opposite second end of the center tube and said body whereby the exposed portion can be gripped by a user to activate the pull-wire igniter;

e) placing a section of shrink tubing over at least part of the pull-wire igniter device to prevent contact of the igniter device with the primer mixture and the pyrotechnic composition to prevent premature activation of the device; and f) sealing the exposed end of the composition, primer mixture and igniter device to prevent the introduction of moisture and contaminants until the moment of actual ignition of the signalling device.

24. A method as described in claim 23 which further includes the step of assembling the pull-wire igniter device from an igniter cup and a pull-wire positioned within said cup, said pull-wire having an end which is coated with a pyrotechnic scratch mixture, said igniter cup being positioned within the end of said center tube with the coated end of the pull-wire extending beyond the cup, the section of shrink tubing is positioned over the coated end of said pull-wire to prevent contact between the coated pull-wire and the primer mixture and the pyrotechnic composition to prevent premature ignition of the device.

25. A method for igniting a pyrotechnic mixture as described in claim 23 wherein the pull-wire igniter device includes a pull-wire having an end coated with a suitable scratch mixture and a straight section at the opposite end, the coated end of said pull-wire is positioned beyond the exposed end of said composition and primer mixture, the section of shrink tubing is positioned over said coated end, said coated end is bent at an angle to lie adjacent to the outer surface of said primer mixture whereby said pyrotechnic signalling device can be ignited by withdrawing the straight end of the pull-wire through the center tube which in turn causes rapid contact of the coated end of the pull-wire with the primer mixture which in turn ignites the pyrotechnic composition.

* * * * *